United States Patent [19]

Eads

[11] Patent Number: 4,752,016

[45] Date of Patent: Jun. 21, 1988

[54] BEVERAGE CAN CLOSURE

[76] Inventor: Stephen R. Eads, 6113 Woodcrest Dr., Tuscaloosa, Ala. 35405

[21] Appl. No.: 131,104

[22] Filed: Dec. 10, 1987

[51] Int. Cl.[4] ..... B65D 51/18

[52] U.S. Cl. ..... 220/253; 220/336; 220/90.2; 220/258

[58] Field of Search ..... 220/90.2, 90.6, 253, 220/258, 336

[56] References Cited

U.S. PATENT DOCUMENTS 4,579,257 4/1986 Brandlein ..... 220/90.6

4,717,039 1/1988 Ayyouli ..... 220/253

*Primary Examiner*—George T. Hall

*Attorney, Agent, or Firm*—Jennings, Carter, Thompson & Veal

[57] ABSTRACT

A disk-like insulating cover for attachment to the top of opened metal beverage cans, providing selectable closure and retention of carbonation. A single drinking spout in the cover allows egress of beverage when aligned with the can opening; rotation of the cover to a misaligned position prevents spillage.

18 Claims, 2 Drawing Sheets

Fig. 1
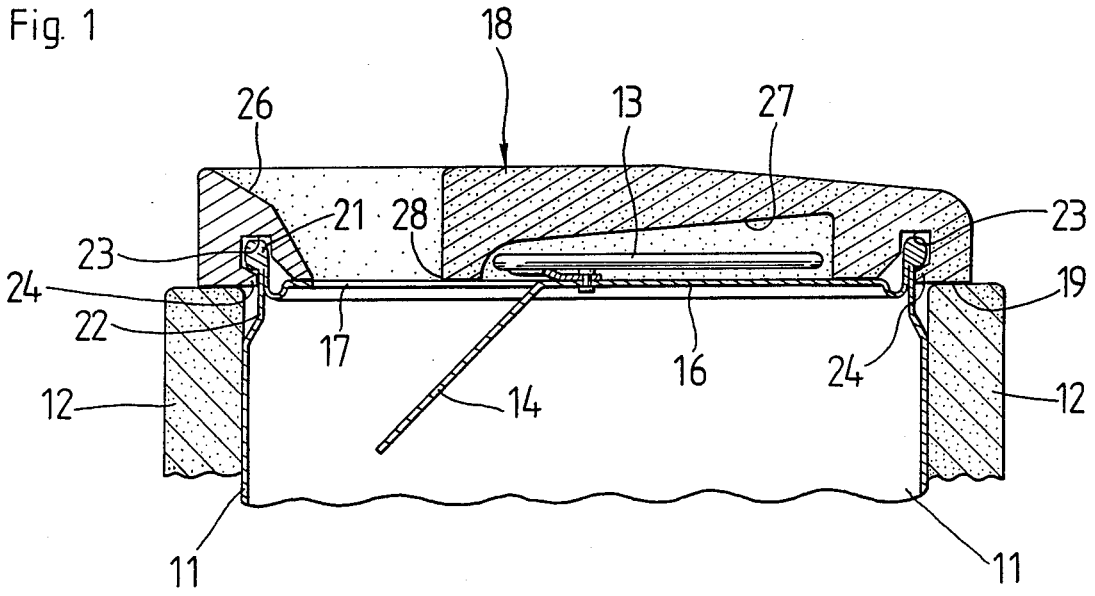
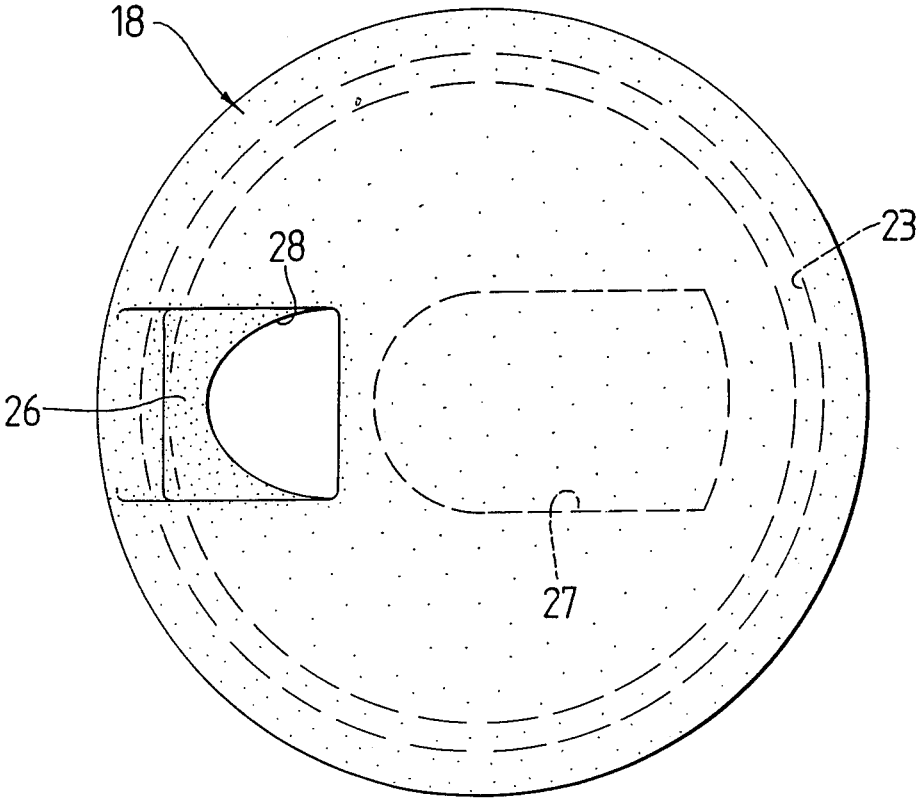
Fig. 2

BEVERAGE CAN CLOSURE

FIELD OF THE INVENTION

The present invention relates to the resealing of previously opened metal beverage cans. More particularly, the present invention relates to a snap-on insulating cover which, in its closed position, serves to reseal such cans to prevent spillage of liquid and loss of carbonation.

BACKGROUND OF THE INVENTION

In recent years the beverage industry has been revolutionized by the wide use of plastic resealable containers. The reclosable tops on these containers retain carbonation efficiently; insulated walls reduce beverage temperature changes. The dull plastic spouts are significantly safer in the hands of children than the sharp metal edges of cans.

Despite these advantages over conventional glass bottles and metal cans, plastic containers create significant disposal and recycling problems. The stability and non-biodegradability of plastic makes landfill disposal impractical. Recycling costs for plastic polymers are significantly higher than those for glass or metal containers. The environmental problems surrounding the use of plastics foreshadow a possible return to conventional metal packaging technology in the beverage industry. However, the problems of metal can reclosability and maintenance of beverage temperature must be solved in an economically acceptable manner. Safety concerns present in metal containers must be addressed for the protection of consumers.

SUMMARY OF THE INVENTION

It is the object of my invention to provide an inexpensive device for the positive reclosure of metal beverage cans.

It is a further object of the present invention to insulate such cans and aid in the maintenance of beverage temperatures.

Yet another object of the present invention is to increase the safety of the metal cans in the hands of consumers by covering the sharp metal edges and drinking surfaces.

These objectives are accomplished in my invention by providing a flexible disk-like cover that attaches securely onto the top of metal beverage cans. The lower surface of the cover contains an annular depression that engages the rim on the can top and snaps into position. A second depression accepts the ring opener and allows the flexible cover to conform to the upper can surface. A single aperture in the cover serves as a drinking spout when aligned with the opening in the beverage can top. Clockwise or counterclockwise rotation of the cover with respect to the can top misaligns the cover aperture and the can top opening to prevent the egress of liquid.

Attachment of my simple invention to a metal beverage can remedies the inherent limitations of the container and provides all the advantages presently available with plastic bottles.

First, the can becomes easily reclosable and reopenable. Twisting the cover to align the cover aperture with the can opening allows easy access to the beverage within. Twisting the cover misaligns the openings and places a solid position of the cover over the can spout. This effectively seals the can to conserve carbonation, prevent loss of the beverage, and keep out foreign objects.

Secondly, the insulating properties of the cover prevent heat loss from the can top area and conserve beverage temperature. Use of the cover in conjunction with a standard insulating can holder creates an efficient constant temperature shroud. The thickness of this shroud gives the metal can insulating properties superior to those available in plastic containers.

Finally, the cover reduces safety problems associated with the sharp edges of metal cans. The smooth surface and rounded drinking spout eliminates contact between the can top and the mouth of the drinker, thereby preventing injuries. With the cover in a closed position, the sharp metal surfaces and ring opener are completely covered—away from the hands of inquisitive children. The addition of the simple cover gives metals cans all the consumer protection features of plastic beverage containers.

BRIEF DESCRIPTION OF THE DRAWINGS

Apparatus embodying features of my invention are illustrated in the appended drawings which form a portion of this disclosure and wherein:

FIG. 1 is a sectional view showing the apparatus attached to a metal beverage can;

FIG. 2 is a top plan view of the upper surface of the apparatus;

DESCRIPTION OF A PREFERRED EMBODIMENT

Figure 3:
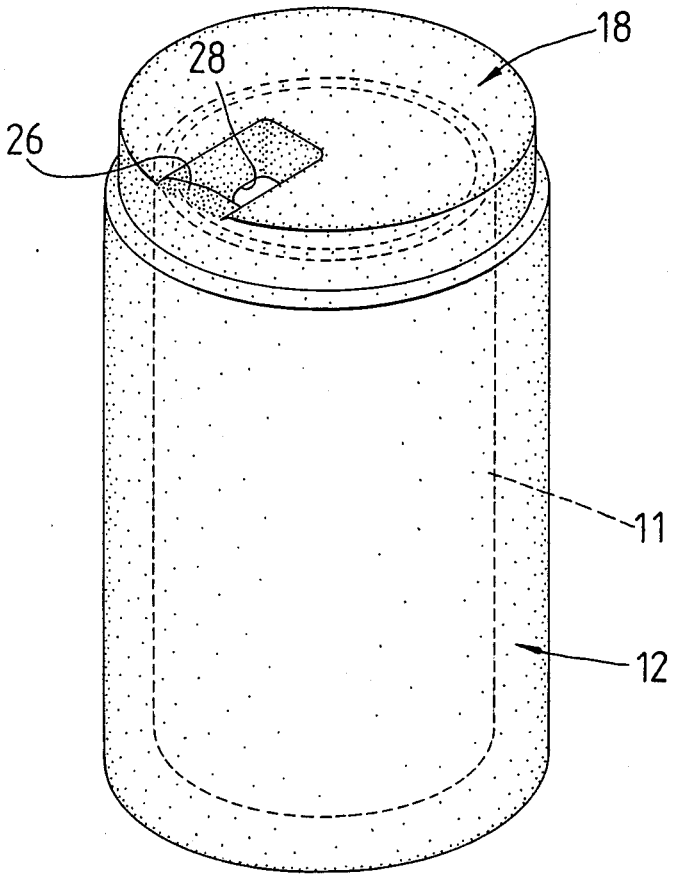
FIG. 3 is a perspective view showing the apparatus attached to a metal beverage can, used in conjunction with an insulating can holder.

My apparatus may be more readily understood by referring to the associated drawings. In FIG. 1, a metal beverage can 11 has been inserted into an insulating can holder 12; the upper end of the can 11 protrudes slightly, exposing a circumferential can rim 22. Ring opening device 13 has been employed to punch in the perforated portion 14 of can surface 16 to open the can and form can aperture 17 in a manner well known in the art. An insulating cover 18 cooperatively engages rim 22 and abuts can holder 12 to form an insulating seal 19.

A flared region 21 of circumferential can rim 22 enters an annular groove 23 formed in the lower surface of cover 18. A flange 24 extends radially inwardly beneath flared region 21, securely gripping rim 22.

A drinking spout 26 is an aperture extending through the cover 18 inwardly of groove 23 and may be aligned cooperatively with beverage can aperture 17. A depression 27 is formed in the lower surface of cover 18 and is positioned radially opposite drinking spout 26 to accept the ring opening device 13. Inclusion of depression 27 allows cover 18 to conform to the upper contours of can 11 and form a liquid resistant seal.

FIG. 2 shows the upper surface of insulating can cover 18 and the relative positioning of the cover's essential features. Annular groove 23 is formed in the lower surface of the cover to accept circumferential can rim 22. Drinking spout 26 fits cooperatively with can aperture 17 when properly aligned. The spout 26 flares outwardly from a lower opening 28 to form drinking spout 26. The contours of drinking spout 26 allow comfortable placement of cover 18 against the mouth of the drinker. The depression 27 is located on the lower surface of cover 18 and positioned to allow acceptance of ring opening devie 13.

In FIG. 3, cover 13 is used in conjunction with insulating can holder 12 to create a complete insulating system for beverage can 11. Opened can 11 is inserted into can holder 12 so that the upper end of can 11 protrudes slightly. Cover 18 is then placed a top can 11. To achieve secure mounting, downward pressure is applied on cover 18 so that the cover snaps into position. If cover 18 is positioned in such a way that drinking spout 26 is aligned with can aperture 17, egress of liquid is permitted. However, if cover 18 is rotated in a clockwise or counterclockwise direction from this position, drinking spout 26 and can aperture 17 are thereby misaligned, preventing liquid egress.

Figure 4:
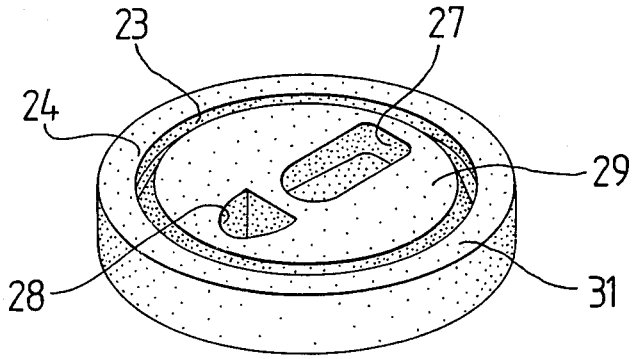
FIG. 4 is a perspective view showing the lower surface of the apparatus.

FIG. 4 shows the lower surface features of cover 18. Flange 24 flares outwardly to form annular groove 23 and allow secure mounting. Lower opening 28 is positioned and shaped so as to correspond with can aperture 17. Depression 27, located radially opposite cover aperture 28, accepts ring opening device 13. Smooth surface 29 provides a tight, liquid-resistant seal with the can surface 16 to prevent spillage and conserve carbonation. Smooth surface 31 forms the insulating seal 19 with the corresponding surface of insulating can holder 12.

While I have shown my invention in one form, it will be obvious to those skilled in the art that it is not so limited but is susceptible of various changes and modifications without departing from the spirit thereof.

What I claim is:

1. An apparatus to effect resealable closure of metal beverage cans comprising:

(a) a circular disk-like member having a lower surface and an upper surface with the diameter of said member being commensurate with a raised circumferential rim formed by said can about the top surface thereof;

(b) an annular depression in lower surface of said disk-like member for engagement of said raised circumferential rim to achieve positive attachment therewith such that said lower surface of said disk-like member fits in cooperative relationship with said top surface and forms a liquid resistant seal therewith; and (c) an aperture proximal said annular depression and extending through said disk-like member for egress of fluids from said can when cooperatively aligned with an opening in said top surface.

2. Apparatus as defined in claim 1 wherein said disk-like member is constructed of durable flexible material so as to closely conform to the top surface.

3. Apparatus as defined in claim 1 wherein said disk-like member is constructed of insulating material.

4. Apparatus as defined in claim 1 wherein said disk-like member contains a single aperture.

5. Apparatus as defined in claim 4 wherein said aperture occupies limited surface area of said disk-like member with the remaining surface area of said disk-like member being sufficient to block the opening in the top surface and prevent egress of fluids contained therein, when said aperture and said opening are not cooperatively aligned.

6. Apparatus as defined in claim 4 wherein said aperture is defined by a planar region normal to said lower surface and an arcuate region intersecting said planar region and flaring upwardly and outwardly away from said lower surface to form a smooth drinking spout.

7. Apparatus as defined in claim 1 wherein said aperture is defined by a planar region normal to said lower surface and an arcuate region intersecting said planar region and flaring upwardly and outwardly away from said lower surface to form a smooth drinking spout.

8. Apparatus as defined in claim 1 wherein said top surface has attached ring opening device and said lower surface of said disk-like member has recessed region positioned so as to receive said ring opening device therein.

9. Apparatus as defined in claim 8 wherein the volume of said recessed region is sufficient such that reception of said ring opening device permits close cooperative fit between lower surface of said disk-like member and said top surface.

10. Apparatus as defined in claim 1 wherein said raised circumferential rim flares outwardly above said top surface with said annular depression in said disk-like member cooperatively formed to receive said circumferential rim in a close fitting relationship.

11. Apparatus as defined in claim 10 wherein a flange extends radially inwardly within said annular depression proximal said lower surface and cooperatively flares to accept the outwardly flaring circumferential rim to positively engage said circumferential rim.

12. Apparatus as defined in claim 11 wherein contact between said flange and said circumferential rim prevents motion in a direction normal to said top surface while allowing relative clockwise and counterclockwise motion between said rim and said flange.

13. Reusable reclosure device for metal beverage cans comprising:

(a) a flexible cover conforming with the top of said can and establishing a liquid and carbonation resistant seal therewith;

(b) an aperture in said cover providing for egress of the contained beverage upon alignment with an opening in the top of said can; and (c) circumferential flange providing snap-on attachment of said cover to a raised circumferential rim on said can.

14. Reclosure device as defined in claim 13 wherein said can top is equipped with metal ring opener, said cover containing a corresponding depression for acceptance of said opener.

15. Reclosure device as defined in claim 14 wherein said aperture defines a funnel-shaped region radially opposite said depression with the downstream end of said funnel being located distal to said depression and serving as a drinking spout.

16. Reclosure device as defined in claim 14 wherein the size of said cover aperture closely approximates the size of said can top opening.

17. Reclosure device as defined in claim 13 wherein said circumferential flange extends outwardly of the circumferential rim of said can and engages said rim below a flared region formed thereon.

18. Reclosure device as defined in claim 17 wherein said engagement restricts motion of said device in direction normal to said can top but allows clockwise or counterclockwise motion between said device and said can in a plane parallel to said can top.

* * * * *